United States Patent [19]

Hirabayashi et al.

[11] Patent Number: 4,702,414

[45] Date of Patent: Oct. 27, 1987

[54] UTRASONIC INJECTING METHOD AND INJECTION NOZZLE

[75] Inventors: Hideo Hirabayashi, Chiba; Masami Endo; Kakuro Kokubo, both of Kanagawa, all of Japan

[73] Assignee: Toa Nenryo Kogyo Kabushiki Kaisha, Tokyo, Japan

[21] Appl. No.: 723,243

[22] Filed: Apr. 15, 1985

[30] Foreign Application Priority Data

Apr. 19, 1984 [JP] Japan ..... 59-77572

[51] Int. Cl.[4] ..... B05B 1/08; B05B 17/04

[52] U.S. Cl. ..... 239/4; 239/5; 239/102.2; 239/533.12

[58] Field of Search ..... 239/4, 5, 102, 533.3–533.12, 239/102.2

[56] References Cited

U.S. PATENT DOCUMENTS

| | | | |
|---|---|---|---|
| 3,756,575 | 9/1973 | Cottell | 239/102 |
| 4,197,997 | 4/1980 | Wu et al. | 239/102 |
| 4,372,491 | 2/1983 | Fishgal | 239/102 |
| 4,474,326 | 10/1984 | Takahashi | 239/102 |
| 4,496,101 | 1/1985 | Northman | 239/102 |
| 4,501,406 | 2/1985 | Walther et al. | 239/102 |

*Primary Examiner*—Andres Kashnikow
*Assistant Examiner*—Michael J. Forman
*Attorney, Agent, or Firm*—Seidel, Gonda, Goldhammer & Abbott

[57] ABSTRACT

An ultrasonic injection nozzle includes an ultrasonic vibration generating device and a vibrating element. The vibrating element is connected to the vibration generating device so as to be vibrated thereby. The vibrating element has formed at its forward end an edged portion to and along which a liquid material is delivered to be atomized.

6 Claims, 5 Drawing Figures

UTRASONIC INJECTING METHOD AND INJECTION NOZZLE

TECHNICAL FIELD

This invention relates generally to the art of ultrasonic injection for atomizing liquid material, and particularly to an ultrasonic injecting method and nozzle suitable for use on a fuel injecting valve for internal combustion engines such as diesel engines, gasoline engines and gas turbine engines, and external combustion engines such as burners for boilers, heating furnaces, heating apparatus and the like, and also for a spray head for drying and producing powdered medicines. While this invention is useful as an injecting nozzle or apparatus for atomizing and injecting liquid material in various applications as described above (the term "liquid material" is intended to mean not only a liquid such as liquid fuel but also various solutions or suspensions such as liquid for producing medicines as well as water or other liquid for use with a humidifying or spraying apparatus), the invention will be described hereinafter with respect to a fuel injecting nozzle particularly for use with internal combustion engines such as diesel and gasoline engines.

BACKGROUND OF THE ART

Various attempts have heretofore been made to supply liquid fuel in atomized form into a combustion or precombustion chamber of an internal combustion engine such as diesel or gasoline engine in order to reduce soot and enhance fuel economy. One of the most common methods is to inject liquid fuel under pressure through the outlet port of an injection nozzle. In such injection it is known that atomization of liquid fuel is promoted by imparting ultrasonic vibrations to the liquid fuel.

There have heretofore been developed two mechanisms for atomizing liquid by ultrasonic waves—(1) the cavitation mechanism and (2) the wave mechanism. The cavitation mechanism is unsuitable for application to an injection valve because of difficulty in controlling the degree of atomizing. The wave mechanism includes the capillary system and the liquid film system. In the capillary system an ultrasonic vibrating element has a capillary aperture formed therethrough. Liquid fuel is introduced through the inlet port of the capillary aperture while the ultrasonic vibrating element is subjected to vibration, whereby the liquid fuel is spread through the outlet of the capillary aperture in a film form over the bottom surface of the vibrating element and then injected in an atomized state, In the liquid film system, an ultrasonic vibrating element is formed on its forward end with a portion flared as in the form of a poppet valve. Liquid fuel is delivered to and spread over the face portion in a film form and then injected in an atomized state.

As is understood from the foregoing, it has been heretofore considered that the mechanism by which liquid is atomized by means of an ultrasonic vibrating element is based on either cavitation or wave motions caused after the liquid is transformed to film, and particularly that wave motions in film are indispensably required to effect atomization of liquid in a large quantity. Accordingly, the arrangements as described above have been hitherto proposed.

However, in actuality the injection nozzles hitherto proposed have such small capacity for spraying that they are unsuitable for use as an injection nozzle for internal combustion engines such as diesel or gasoline engines which require a large amount of atomized fuel.

In an attempt to accomplish atomization of liquid fuel in a large quantity, the inventors of this application have conducted extensive research and experiments on the mechanism by which liquid is ultrasonically atomized as well as on the configuration of the ultrasonic vibrating element and found out that it is possible to effect atomization of liquid fuel by an atomization mechanism distinct from the atomization mechanisms as described hereinabove. More specifically, the inventors have discovered that liquid fuel may be atomized in a large quantity from an edged portion formed at an end of an ultrasonic vibrating element by delivering liquid fuel to and past said edged portion in a film state. This invention has been developed on the basis of such novel discovery.

SUMMARY OF THE INVENTION

According to this invention, an ultrasonic injection nozzle is provided which comprises an ultrasonic vibration generating means and a vibrating element connected to said vibration generating means so as to be vibrated thereby, said vibrating element being formed at its forward end with an edged portion to and along which a liquid material is delivered to be atomized.

In a preferred embodiment of this invention, the ultrasonic vibration generating means is always in operation, hence the vibrating element is continuously vibrated while liquid material is intermittently fed to the vibrating element, thereby eliminating the time lag involved in initiation of vibration, the defect of the conventional ultrasonic injection nozzle in which the vibrating element is vibrated only when injecting liquid material.

Further, in a preferred embodiment of the invention, the vibrating element having the edged portion is so arranged as to be located adjacent the outlet port of the injection nozzle, whereby a very compact ultrasonic injection nozzle may be provided.

In addition to the intermittent injection nozzle as described above, the present invention may be applicable to continuous burning such as a burner and also to a spraying apparatus for spray drying to produce powdered medicine.

Accordingly, a primary object of this invention is to provide an ultrasonic injecting method and injection nozzle capable of atomizing a liquid material in a amount on an either intermittent or continuous basis.

Another object of the invention is to provide an ultrasonic injecting method and injection nozzle for use on internal combustion engines such as a diesel engine, gasoline engine, gas turbine engine and the like, or for use on external combustion engines such as burners for boilers, heating furnaces, heating apparatus and the like for atomizing liquid fuel in a uniform manner and in a large quantity to thereby provide for attaining complete combustion in a short time, resulting in preventing emission of soot as well as improving the fuel economy.

Another object of the invention is to provide an ultrasonic injecting method and injection nozzle for use on internal combustion engines which are capable of not only atomizing liquid in a large amount but also atomizing liquid even at a low flow rate at which the prior art was unable to effect atomizing, to thereby enhance fuel efficiency.

Still another object of the invention is to provide an ultrasonic injecting method and injection nozzle for use on an internal combustion engine which provide for reducing soot and improving fuel economy and which is capable of continuous operation and highly suitable for practical use.

Still another object of the invention is to provide an ultrasonic injecting method and injection nozzle which are capable of fuel injection with no time-lag.

Yet another object is to provide an ultrasonic injecting method and injection nozzle which are useful not only for spraying a medicine producing solution or suspension to dry the materials contained therein as for producing powdered medicine but also for humidifying a room or material.

Another object of the invention is to provide an ultrasonic injecting method and injection nozzle which can make the construction compact in size.

BRIEF DESCRIPTION OF THE DRAWINGS

These and other objects and features of the present invention are more fully disclosed in the following specification, reference being had to the accompanying drawings, in which.

PREFERRED FORMS OF THE INVENTION

An ultrasonic injection nozzle according to this invention will be described in detail with reference to the accompanying drawings.

Figure 1:
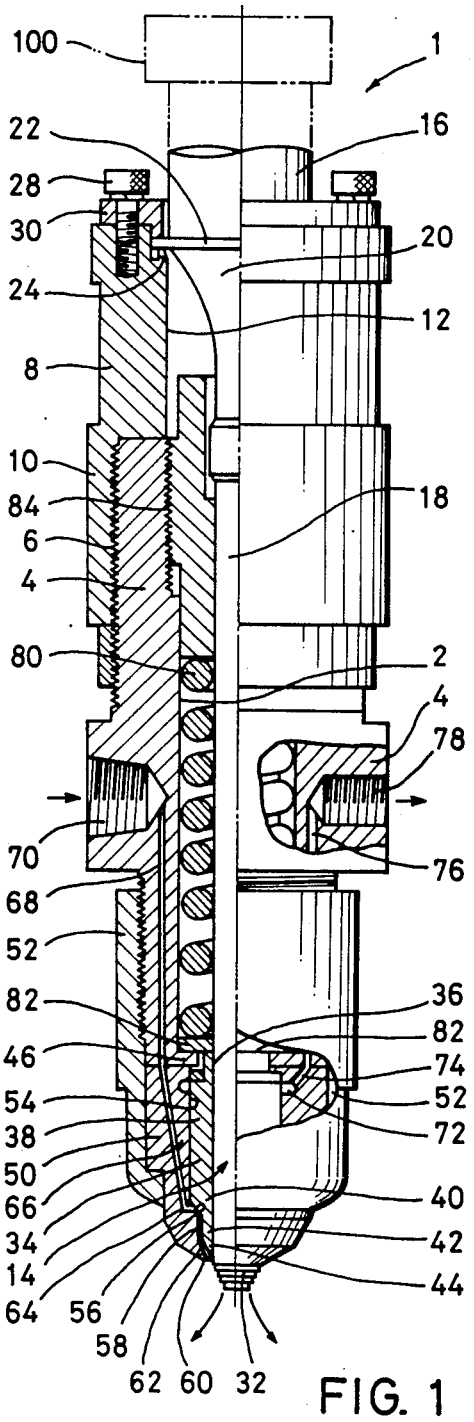
FIG. 1 is a fractional cross-sectional view of the ultrasonic injection nozzle according to the present invention.

Referring to FIG. 1, the ultrasonic injection nozzle 1 according to this invention includes a generally cylindrical elongated housing 4 having a central bore 2 extending centrally therethrough. Threaded to the external thread 6 on the upper portion of the housing 4 is the lower mounting portion of a vibrator holder 8 which has a through bore 12 extending centrally therethrough coaxially with and in longitudinal alignment with the central bore of the housing 4.

A vibrating element or vibrator 14 is mounted in the through bore 12 of the vibrator holder 8 and the central bore 2 of the housing 4. The vibrating element 14 comprises an upper body portion 16, an elongated cylindrical vibrator shank 18 having a diameter smaller than that of the body portion, and a transition portion 20 connecting the body portion 16 and shank 18. The body portion 16 has an enlarged diameter collar 22 therearound which is clamped to the vibrator holder 8 by a shoulder 24 formed on the inner periphery of the vibrator holder 8 adjacent its upper end and an annular vibrator retainer 30 fastened to the upper end face of the vibrator holder 8.

The shank 18 of the vibrating element 14 extends downwardly or outwardly beyond the housing 4. The forward end of the vibrating element 14, that is, the forward end of the shank portion 18 is formed with an edged portion 32 as will be described in more details hereinafter. A hollow needle valve 34 is mounted for slidable movement in that portion of the vibrating element 14 extending beyond the housing 4.

The hollow needle valve 34 is generally of cylindrical shape, and comprises an upper reduced-diameter portion 36 adjacent its upper end, a central large-diameter portion 38, a tapered portion 40 sloping from the large-diameter portion 38, a small-diameter portion 42 connected to the tapered portion 40, and a tapered forward end portion 44 sloping from the small-diameter portion 42. The extreme end of the tapered forward end portion 44 is disposed adjacent the edged portion 32 of the vibrating element 14. On the other hand, the upper reduced-diameter portion 36 of the hollow needle valve 34 extends upwardly beyond an annular shoulder 46 extending radially inwardly from the lower end portion of the housing 4.

The hollow needle valve 34 is housed in the needle valve holder 50 which is detachably secured to the housing 4 by means of a holder sheath 52 which is affixed to the outer periphery of the holder 50. The inner configuration of the needle valve holder 50 comprises a large-diameter bore portion 54 in which the central large-diameter portion 38 of the hollow needle valve 34 is adapted to slidably move, a sloped portion 56 complementary to the tapered portion 40 of the needle valve 40, a small-diameter bore portion 58, and a sloped forward end portion. The small-diameter bore portion 58 and sloped forward end portion 60 cooperate with the small-diameter portion 42 and sloped forward end portion 44 of the hollow needle valve 34 to define a liquid fuel supply passage 62.

The needle valve holder 50 is formed around its sloped portion 56 with an annular fuel reservoir 64 opening radially inwardly which is in communication with a fuel supply passage 66 extending through the wall of the needle valve holder 50. Said fuel supply passage 66 is in communication with a fuel inlet passage 68 extending through the wall of the housing 4, which inlet passage 68 is in turn connected with a fuel inlet port 70 of the housing 4.

The needle valve holder 50 is formed around the upper part of the large-diameter bore portion 54 of the needle valve holder 50 with an annular return fuel sump 72 radially inwardly opening which is connected with a fuel outlet port 78 via a fuel return passage 74 and a fuel outlet passage 76 formed through the walls of the needle valve holder 50 and the housing 4, respectively.

A compression spring 80 is disposed in an annular space defined between the peripheral wall of the central bore 2 in the housing 4 and the outer periphery of the vibrator shank 18. The lower end of the compression spring 80 abuts against the top end face of the upper reduceddiameter portion 36 of the hollow needle valve 34 by means of an annular spring retainer 82 while the upper end of the spring abuts against the bottom surface of an injection pressure regulating member 84 which is a cylindrical member disposed in the space between the peripheral wall of the central bore 2 in the housing 4 and the outer periphery of the vibrator shank 18 and threaded to the inner periphery of the housing 4. Thus, the pressure on the needle valve 34 may be adjusted by rotating the injection pressure regulating member 84 relative to the housing 4.

The operation of the ultrasonic injection nozzle 1 will now be described below.

In operation, liquid fuel is introduced through the fuel inlet port 70 and supplied through the fuel inlet passage 68 and fuel supply passage 66 into the fuel reservoir 64 which is closed by the tapered portion of the hollow needle valve 34 urged downwardly by the spring 80. Consequently, the pressure in the reservoir 64 is built up as it is continuously supplied with liquid fuel. When the pressure in the fuel reservoir 64 reaches a certain level, the hollow needle valve 34 is caused to move upward against the biasing force of the spring 80.

The upward movement of the hollow needle valve 34 causes the fuel reservoir 64 to be opened to the fuel supply passage 62, which is thus supplied with the liquid fuel. From the fuel supply passage 62, the fuel is delivered to the edged portion 32 formed on the forward end of the vibrating element 14.

Figure 2:
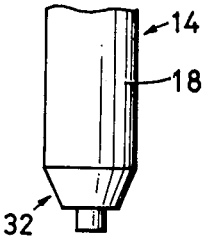
FIGS. 2 and 3 are fractional front views of alternate forms of the edged portion at the forward end of the vibrating element.
Figure 3:
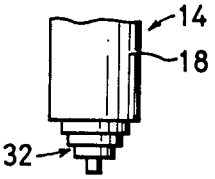
Figure 4:
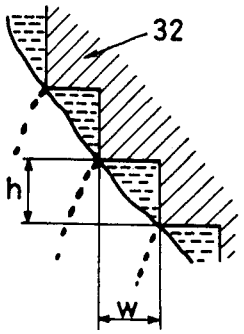
FIG. 4 is a fractional enlarged view illustrating the operation of the edged portion.

The edged portion 32 of the vibrating element 14 may be in the form of a staircase including three concentric steps having progressively reduced diameters as shown in FIG. 1, or may comprise two or five steps as shown in FIGS. 2 and 3. Whatever configuration it may be, it is important that the edged portion be formed around its outer periphery with an edge or edges. While the edged portion 32 as shown in FIGS. 1 to 3 is of a stepped configuration having progressively reduced diameters, it may be of a configuration having progressively increased diameters or progressively reduced and then increased diameters. Further, as shown in FIG. 4, the geometry such as the width (W) and height (h) of the step are such that the edge may act to render the liquid fuel filmy and to dam the liquid flow.

Figure 5:
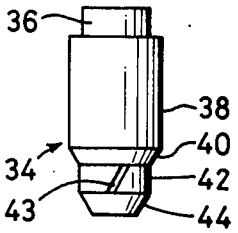
FIG. 5 is a front view of the hollow needle valve.

The vibrating element 14 is continuously vibrated by ultrasonic vibration generating means 100 operatively connected to the body portion 16, so that the liquid fuel is atomized and injected outwardly as it is delivered to the edged portion 32. It is important that uneven injection be eliminated so as to insure uniform injection around an injection valve. In this regard, as shown in FIG. 5, the small-diameter portion 42 of the hollow needle valve 34 may be a plurality of, say, two diametrically opposed angularly extending grooves 43. It has been found that such arrangement causes turbulence to be produced in the fuel supply passage as well as imparting a swirl to the fuel being injected to thereby eliminate uneven injection. In addition, such arrangement may also serve to promote separation of the spray of fuel off the edges as well as to enhance the atomization.

An example of various parameters and dimensions as to the ultrasonic injection nozzle according to the invention as described hereinabove is as follows:

Output of ultrasonic vibration generating means: 10 watts
Amplitude of vibration of vibrating element: 30 μm
Frequency of vibration of vibrating element: 38 KHz
Geometry of vibrating element
First step: 7 mm in diameter
Second step: 6 mm in diameter:
Third step: 5mm in diameter
Height (h) of each step: 1.5 mm
Type of fuel: Gas oil
Flow rate of fuel: 0.06 $cm^3$ per injection
Injection pressure of fuel: 70 $kg/cm^2$
Temperature of fuel: Normal temperature
Material for vibrating element: Titanium (or iron)
Notes:

(1) It is advantageous to make the amplitude of vibration of the vibrating element as great as possible.
(2) The vibrating element should have a frequency of vibration higher than 20 KHz.
(3) The injection fuel of fuel should be made to approach the pressure in the engine chamber.

A portion (surplus) of the fuel supplied to the fuel reservoir 64 flows through the fire space (in the order of μm) between the hollow needle valve 34 and the needle valve holder 50 to be collected into the return fuel sump 72, and is then returned to the fuel outlet 78 through the fuel return passages 74 and 76. The fuel outlet 78 is connected via a suitable conduit (not shown) with the fuel tank so that the excess fuel is recirculated to the tank.

As the pressure in the fuel reservoir 64 drops, the hollow needle valve 34 is moved downward under the action of the spring 80 to close the fuel reservoir 64, so that the delivery of fuel to the edged portion 32 of the vibrating element 14 is interrupted, and the fuel injection from the nozzle 1 is discontinued.

According to this invention, mistiming in fuel injection due to a time lag in initiation of vibration is avoided since the vibrating element 14 may be kept in operation irrespective of the fuel supply.

As indicated above, the injection nozzle of this invention is capable of providing a large amount of injection at 0.06 $cm^3$ per injection which makes it possible to put the nozzle to practical use as an injection nozzle for an internal combustion engine. This is 500 to 1,000 times as high as the flow rate as was reported to be possible with the prior art ultrasonic injection nozzle. Furthermore, the present invention is also applicable to a burner for continuous combustion in which the flow rate may be in the order of 100 l/hr. This invention may also be used as a spray drying apparatus for producing powdered medicines.

In addition to the provision for atomization of liquid in a large quantity as described above, this invention is also characterized in that it is capable of providing generally uniform distribution in atomized particles with an average particle radius in the order of 10 to 30 μm.

Industrial Applications

As is understood from the foregoing, the present invention provides an ultrasonic injecting method and injecting nozzle capable of not only atomizing a liquid material in a uniform manner and in a large quantity but also atomizing a liquid material even at a low flow rate, on an either intermittent or continuous basis.

Accordingly the ultrasonic injecting method and injection nozzle according to this invention is suitable for use on internal combustion engines such as a diesel engine, gasoline engine, gas turbine engine and the like, for use on external combustion engines such as burners for boilers, heating furnaces, heating apparatus and the like, or for use on a spraying or humidifying apparatus.

What is claimed is:

1. An ultrasonic injection nozzle comprising means for generating ultrasonic vibrations, an elongated vibrating element connected at one end to said ultrasonic vibration generation means and having an edged portion at the other end, said edged portion having at least two steps, a liquid material being severed and atomized at an edge of each said step, a hollow needle valve slidably mounted around said vibrating element adjacent said other end having said edged portion, a needle valve holder adapted to hold said hollow needle valve for slidable movement and cooperating with the hollow needle valve to define a supply passage for said liquid material to the edged portion adjacent the vibrating element, a spring means normally urging said hollow needle valve toward said holder to close said liquid material supply passage whereby the liquid material in the passage urges said valve against said spring means and the liquid material flows to said edged portion.

2. An ultrasonic injecting method of atomizing a liquid material by vibrating a vibrating element by means for generating ultrasonic vibrations which is operably connected to said vibrating element at one end thereof, characterized by:

(a) providing a multi-stepped edged portion having at least two steps at the other end of said vibrating element;

(b) feeding a liquid material to the edge of the first step of the multi-stepped edged portion;

(c) partially severing and atomizing the liquid material at the first step;

(d) feeding the excess portion of the liquid material which is not severed and atomized at the first step to the edge of the second step of the multi-stepped edge portion; and (e) severing and atomizing the excess portion of the liquid material at the second step.

3. The ultrasonic injecting method according to claim 2, wherein said vibrating element is continuously vibrated, and the feeding of the liquid material to the edged portion of the vibrating element is intermittently effected.

4. The ultrasonic injecting method according to claim 2, wherein said liquid material is liquid fuel for use with an internal combustion engine such as a diesel engine, gasoline engine, or an external combustion engine such as a burner.

5. The ultrasonic injecting method according to claim 2, wherein said liquid material is a suspension from which powdered medicine is to be produced.

6. The ultrasonic injecting method according to claim 2, wherein said vibrating element is continuously vibrated, and the feeding of the liquid material to the edged portion of the vibrating element is continuously effected.

* * * * *